US010753541B2

(12) United States Patent
Aguiar et al.

(10) Patent No.: US 10,753,541 B2
(45) Date of Patent: Aug. 25, 2020

(54) HANDLE ASSEMBLY FOR A PORTABLE PRESSURIZED GAS CYLINDER

(71) Applicant: AMTROL Licensing Inc., West Warwick, RI (US)

(72) Inventors: Carlos Aguiar, Oporto (PT); Ana Tenreiro, Oporto (PT)

(73) Assignee: AMTROL LICENSING INC., West Warwick, RI (US)

( * ) Notice: Subject to any disclaimer, the term of this patent is extended or adjusted under 35 U.S.C. 154(b) by 248 days.

(21) Appl. No.: 15/981,367

(22) Filed: May 16, 2018

(65) Prior Publication Data

US 2019/0353305 A1 Nov. 21, 2019

(51) Int. Cl.
*F17C 13/04* (2006.01)
*B65D 25/28* (2006.01)

(52) U.S. Cl.
CPC ..... *F17C 13/04* (2013.01); *B65D 25/282* (2013.01); *F17C 2201/0109* (2013.01); *F17C 2201/058* (2013.01); *F17C 2203/0636* (2013.01); *F17C 2205/0165* (2013.01); *F17C 2209/224* (2013.01)

(58) Field of Classification Search
CPC ..... F17C 13/04; B65D 25/282; B65D 25/28
USPC ..... 220/581, 759, 760, 212.5, 769, 768; 206/0.6; 16/427, 425, 422, 430
See application file for complete search history.

(56) References Cited

U.S. PATENT DOCUMENTS 3,776,412 A 12/1973 Mink
5,709,252 A * 1/1998 Princiotta ..... B60P 3/055 108/55.3

FOREIGN PATENT DOCUMENTS

| | | |
|---|---|---|
| DE | 9408638 | 7/1994 |
| DE | 19639997 | 3/1998 |
| DE | 10308676 | 9/2004 |
| EP | 1041339 | 10/2000 |
| EP | 1296091 | 3/2003 |
| EP | 1744094 | 1/2007 |
| EP | 2933547 | 10/2015 |
| EP | 3048358 | 7/2016 |
| FR | 2729739 | 7/1996 |

(Continued)

OTHER PUBLICATIONS

PCT/US2019/032356; International Search Report and Written Opinion of the Intl. Searching Authority dated Oct. 14 2019II 72 pages.

*Primary Examiner* — Robert J Hicks
(74) *Attorney, Agent, or Firm* — Tucker Ellis LLP; Carlos Garritano

(57) ABSTRACT

Provided is a handle assembly for a cylinder. The handle assembly includes a shroud configured to attach to a collar of the cylinder to partially surround a valve port of the cylinder, the shroud having a body with first and second ends circumferentially spaced from one another to define a gap through which a valve is configured to extend, and a plurality of circumferentially spaced locking protrusions projecting from the body, and a handle configured to attach to the shroud, the handle having a body defining a channel for receiving the shroud, and first and second ends circumferentially spaced from one another to define a gap through which the valve is configured to extend, wherein the channel includes a plurality of openings in a wall thereof through which the locking protrusions extend when the handle is attached to the shroud to secure the handle to the shroud.

20 Claims, 14 Drawing Sheets

(56) References Cited

FOREIGN PATENT DOCUMENTS

| | | |
|---|---|---|
| JP | 03104600 | 10/1991 |
| WO | 9711309 | 3/1997 |

* cited by examiner

HANDLE ASSEMBLY FOR A PORTABLE PRESSURIZED GAS CYLINDER

TECHNICAL FIELD

In general, the present invention relates to a portable pressurized gas cylinder, and in particular to a handle assembly for a portable pressurized gas cylinder.

BACKGROUND OF THE INVENTION

A variety of pressurized gas cylinders have been used for storage and transportation of pressurized gas products for household and industrial. Many of these cylinders have traditionally been fabricated of steel. One problem for steel pressure cylinders has been portability. For steel cylinders, any handles provided are typically formed from the same steel material as the cylinder itself. Due to the properties of steel, these traditional handles have been problematic. The hardness of steel makes it unyielding when gripped, and makes it difficult to form ergonomic surfaces, all of which makes the traditional steel cylinders painful to handle, especially when filled to maximum capacity.

Attempts to form an ergonomic handle from steel have generally been limited by practicality due to the difficulty and expense involved. It is difficult and expensive to form a handle volume from a typical metallic shroud that adequately fills the hand for optimal ergonomics. The lack of volume in typical steel handles causes the contact zone of the cylinder with the hand to be too small. The weight distribution on the hand is therefore concentrated in a small area of the hand, which makes traditional cylinders painful and/or makes them effectively heavier than they actually are due to practical limitations on how much weight n be lifted comfortably by hand with such handles.

SUMMARY OF THE INVENTION

In accordance with an embodiment of the present invention, a handle assembly for a cylinder is provided. The handle assembly includes a shroud configured to attach to a collar of the cylinder to partially surround a valve port of the cylinder, the shroud having a body with first and second ends circumferentially spaced from one another to define a gap through which a valve is configured to extend, and a plurality of circumferentially spaced locking protrusions projecting from the body, and a handle configured to attach to the shroud, the handle having a body defining a channel for receiving the shroud, and first and second ends circumferentially spaced from one another to define a gap through which the valve is configured to extend, wherein the channel includes a plurality of openings in a wall thereof through which the locking protrusions extend when the handle is attached to the shroud to secure the handle to the shroud.

In accordance with an embodiment of the present invention, a portable gas cylinder is provided. The gas cylinder includes a gas tank having an upper portion having a valve port and a collar partially surrounding the valve port, the collar having first and second ends circumferentially spaced from one another to define a gap through which a valve is configured to extend, a base, and a flange extending radially outwardly from the base, and a handle assembly attached to the gas tank, the handle assembly including a shroud having a body attached to the collar with first and second ends circumferentially spaced from one another to define a gap through which the valve is configured to extend, and a plurality of circumferentially spaced locking protrusions projecting from the body, and a handle attached to the shroud, the handle having a body defining a channel in which the shroud is disposed and first and second ends circumferentially spaced from one another to define a gap through which the valve is configured to extend, wherein the channel includes a plurality of openings in a wall thereof through which the locking protrusions extend to secure the handle to the shroud.

In accordance with an embodiment of the present invention, a method of assembling a portable gas cylinder is provided, where the gas cylinder includes a handle assembly and a gas tank having an upper portion having a valve port and a collar partially surrounding the valve port. The method includes deflecting a shroud of the handle assembly from a first position to a second position where ends of the shroud are moved away from one another, positioning the shroud around the collar until the shroud surrounds the collar and is returned to the first position, and lowering a handle of the handle assembly toward the shroud until that the shroud and collar are received in a channel of the handle and locking protrusions of the shroud are received in openings in a wall of the channel.

These and other objects of this invention will be evident when viewed in light of the drawings, detailed description and appended claims.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof, and wherein.

DETAILED DESCRIPTION OF THE INVENTION

Figure 1:
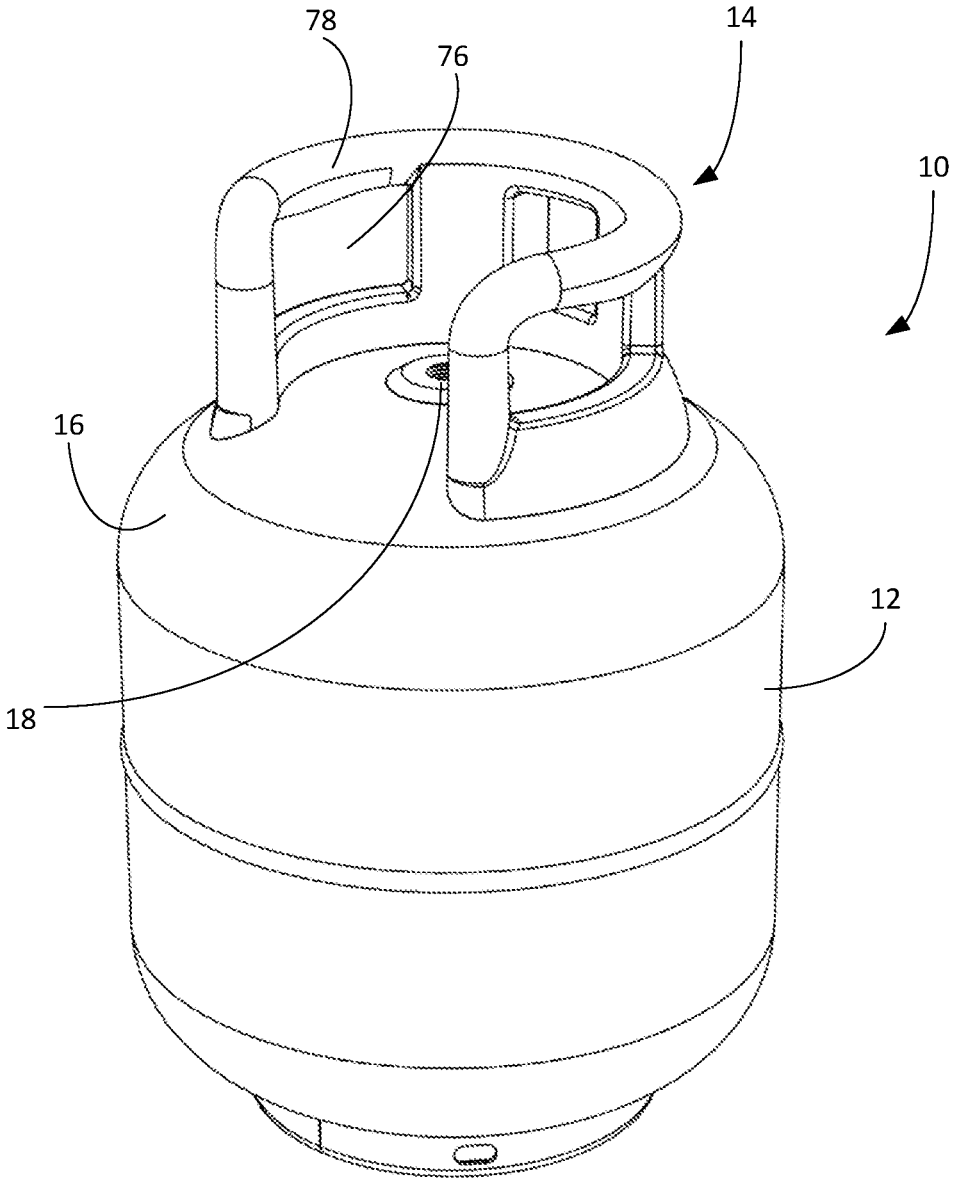
FIG. 1 is a front perspective view of a gas cylinder.

Embodiments of the invention relate to methods and systems that relate to a portable gas cylinder. The cylinder has a gas tank having an upper portion having a valve port and a collar partially surrounding the valve port. The collar has a body and a flange extending radially outwardly from the body. The cylinder also has a handle assembly attached to the gas tank. The handle assembly includes a shroud attached to the collar and a handle attached to the shroud. The shroud has a body, at least one upper protrusion projecting from the body above the flange of the collar to prevent downward movement of the shroud in a first direction relative to the collar, at least one lower protrusion projecting from the body below the flange of the collar to prevent upward movement of the shroud relative to the collar in a second direction opposite the first direction, a plurality of circumferentially spaced locking protrusions projecting from the body, and at least one anti-rotate element interacting with the collar to prevent rotation of the shroud relative to the collar. The handle has a body defining a channel in which the shroud is disposed, where the channel includes a plurality of openings in a wall thereof through which the locking protrusions extend to secure the handle to the shroud.

With reference to the drawings, like reference numerals designate identical or corresponding parts throughout the several views. However, the inclusion of like elements in different views does not mean a given embodiment necessarily includes such elements or that all embodiments of the invention include such elements. The examples and figures are illustrative only and not meant to limit the invention, which is measured by the scope and spirit of the claims.

Turning now to FIGS. 1-4, a portable gas cylinder is shown generally at reference numeral 10. The gas cylinder 10 includes a gas tank 12 configured to store a suitable pressurized gas and a handle assembly 14 attached to the gas tank 12. The gas tank 12 may be made of a suitable material, such as metal, and the handle assembly 14 may be made of a suitable non-metal material, such as plastic that provides improved ergonomics and portability relative to cylinders with steel handles. The gas tank 12 includes an upper portion 16 having a valve port 18 and a mounting collar 20 partially surrounding the valve port 18. The mounting collar 20 may be secured to the upper portion 16 in any suitable manner, such as by welding, or may alternatively be integrally formed with the upper portion 16.

The mounting collar 20 has first and second ends 24 and 26 circumferentially spaced from one another to define a gap through which the valve extends, a curved base 22 that is attached to the upper portion 16, and a curved flange 28 extending radially outwardly from the base 22. The flange 28 includes at least one notch 30, and in the illustrated embodiment two notches 30 extending inward for receiving a corresponding protrusion on a shroud of the handle assembly 14. The flange 28 can also include angled portions 32 at the first and second ends 24 and 26 of the collar 20 for abutting an anti-rotate element of the shroud. The mounting collar 20 is substantially C-shaped, although other configurations may be provided that provide a space for the valve.

Referring now to FIGS. 5-12 in addition to FIG. 1, the handle assembly 14 will be discussed in detail. The handle assembly 14 includes a shroud 40 that attaches to the mounting collar 20 and a handle 42 that attaches to the shroud 40. The handle assembly 14 and mounting collar 20 are designed to provide an open style handle that provides a space between ends of the handle assembly 14 and mounting collar 20 for a valve and its attachments to extend through, such as a valve having a ninety-degree bend. The handle assembly 14 thus provides an ergonomic and light weight handle that is usable with vertical valves and lateral valves.

Figure 5:
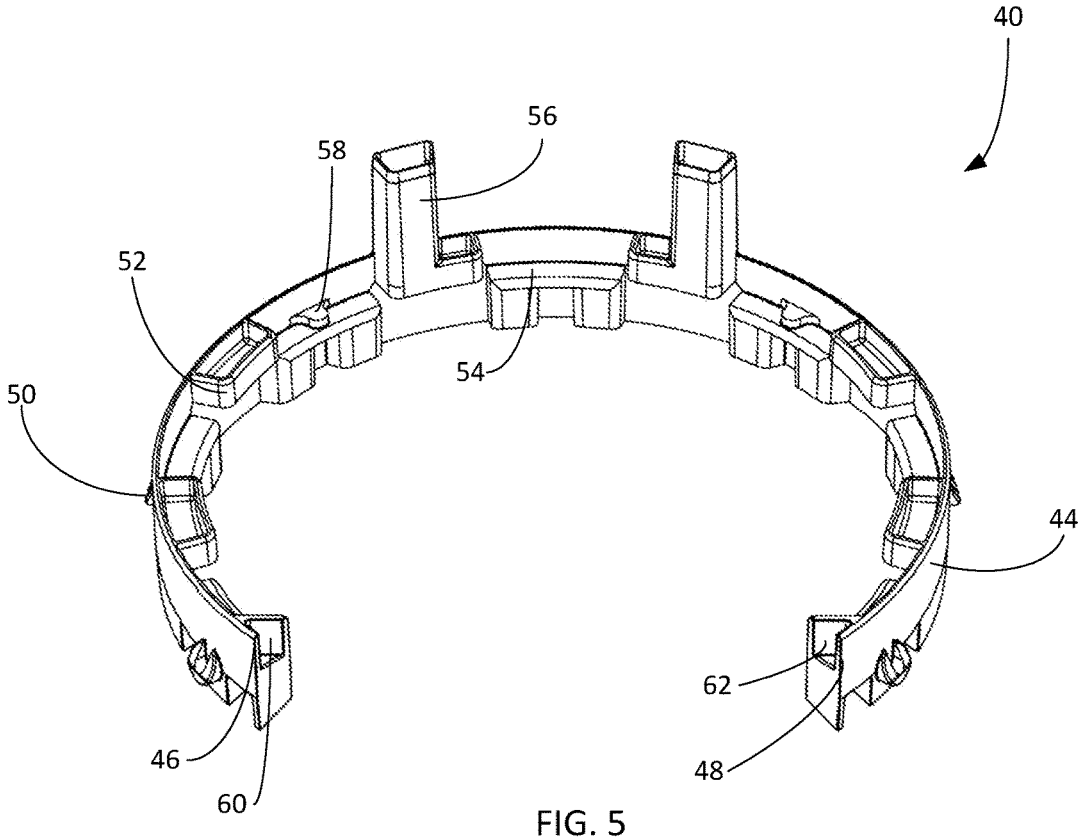
FIG. 5 is front perspective view of a shroud of the gas cylinder.
Figure 6:
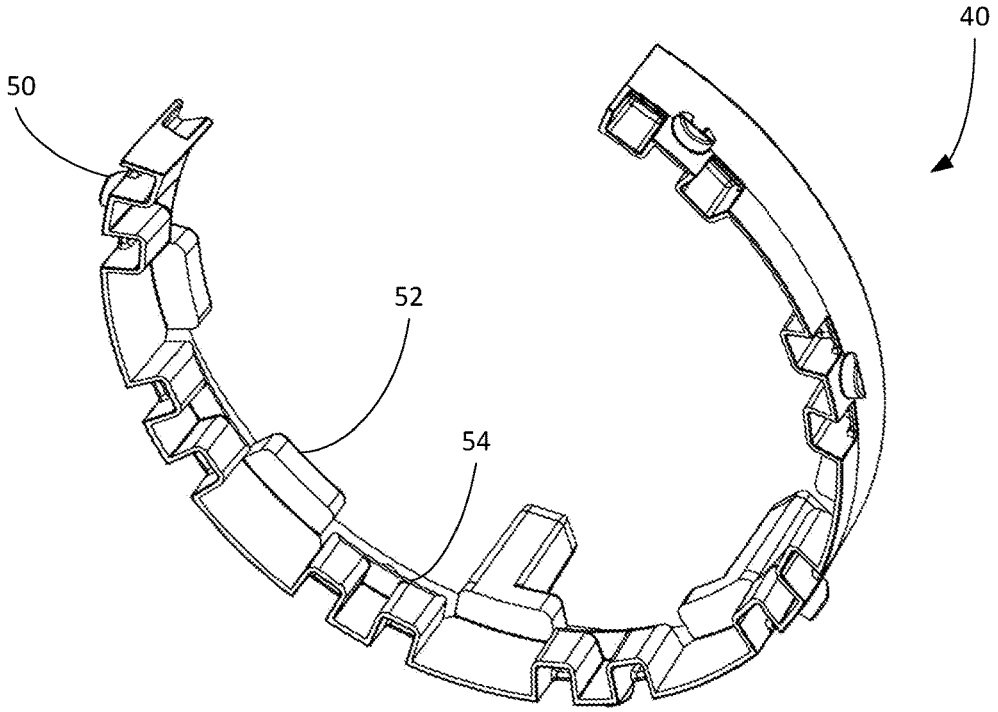
FIG. 6 is a bottom perspective view of the shroud.
Figure 7:
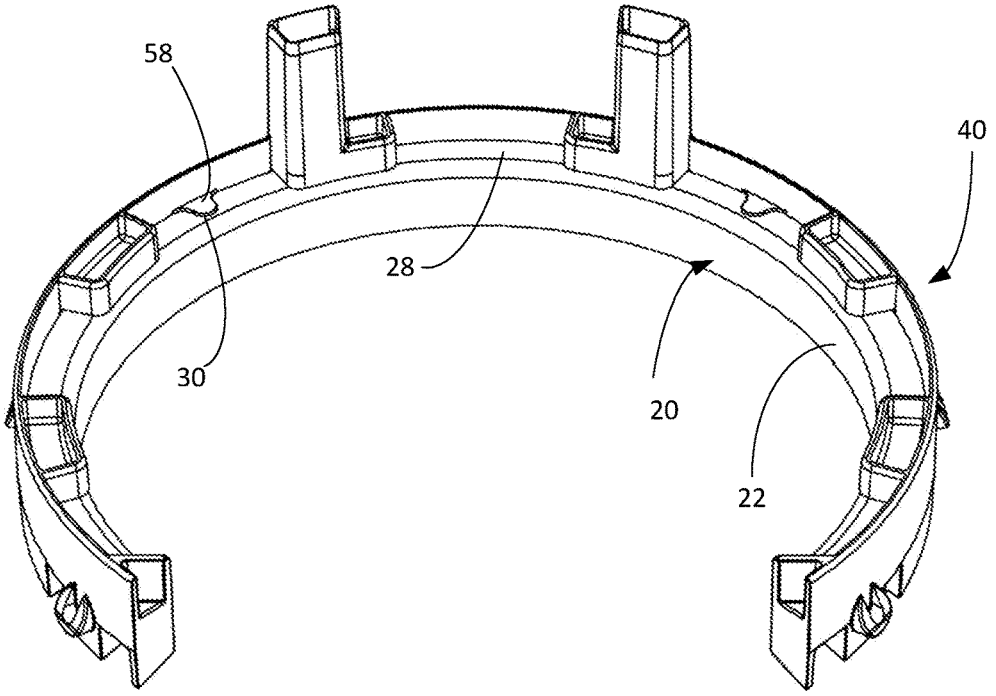
FIG. 7 is a front perspective view of the shroud positioned relative to the mounting collar.

Referring now to the shroud 40 in detail and as shown in FIGS. 5 and 6, the shroud 40 has a curved body 44 with first and second ends 46 and 48 circumferentially spaced from one another to define a gap through which the valve extends. The shroud 40 is shaped similarly to the mounting collar 20, such as substantially C-shaped, such that the shroud 40 surrounds and abuts the mounting collar 20 and partially surrounds the valve port 18 as shown in FIG. 7. The shroud 40 includes a plurality of circumferentially spaced locking protrusions 50 projecting from the body 44, such as a plurality of protrusions projecting radially outward from an outer surface of the shroud 40. The protrusion 50 are provided near a bottom of the shroud 40 and are angled such that a lower portion of the protrusion project radially outward from the outer surface of the shroud 40 farther than an upper portion of the protrusion.

Figure 8:
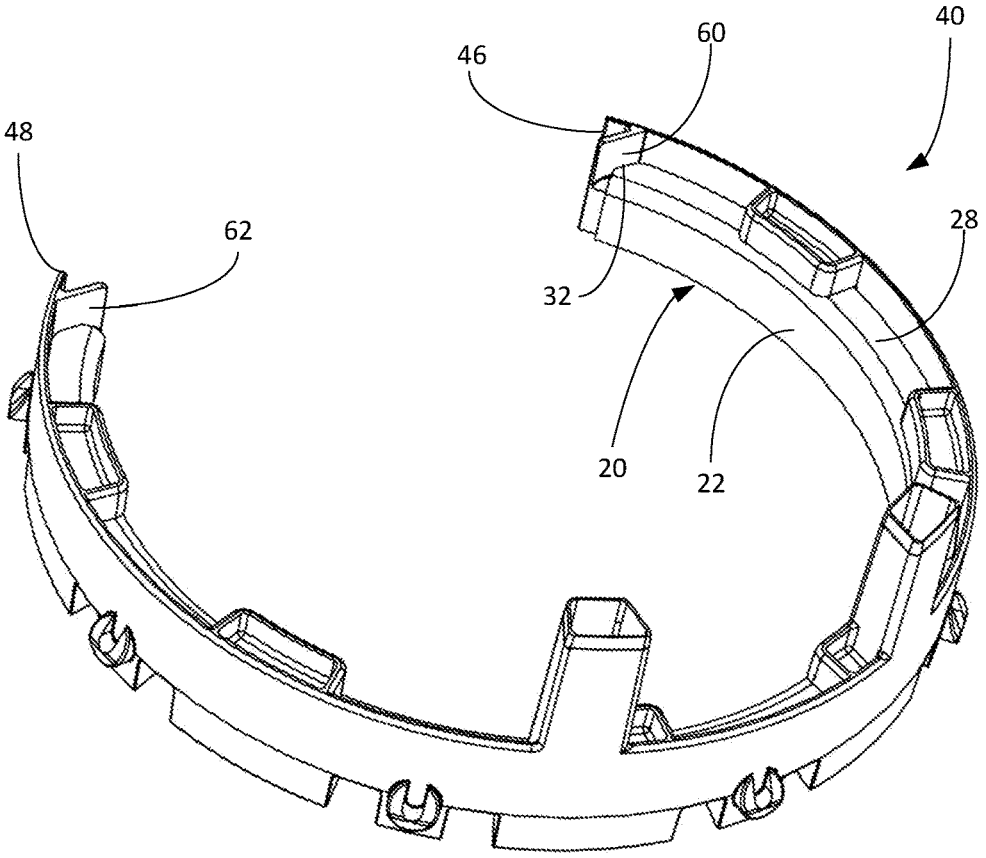
FIG. 8 is a bottom perspective view of the shroud positioned relative to the mounting collar.

The shroud 40 additionally includes at least one upper protrusion 52 projecting from the body 44 to prevent downward movement of the shroud 40 in a first direction relative to the collar 20 and at least one lower protrusion 54 projecting from the body 44 to prevent upward movement of the shroud 40 relative to the collar in a second direction opposite the first direction. As illustrated, the shroud 40 includes a plurality of upper and lower protrusions 52 and 54 projecting inward from the body 40 that define therebetween a space for receiving the flange 28 of the mounting collar 20. The upper and lower protrusion 52 and 54 alternate around the body 44 such that the protrusions 52 or 54 have the other of the protrusions 52 or 54 on either side thereof except at the first and second ends 46 and 48. When the shroud 40 is positioned relative to the flange 20 as shown in FIGS. 7 and 8, a bottom surface of each upper protrusion 52 abuts or is in close proximity to a top surface of the flange 28, and an upper surface of each lower protrusion 54 abuts or is in close proximity to a bottom surface of the flange 28.

The shroud 40 can additionally include at least one projection 56 extending upward in the first direction to serve as a guide for the handle 42 as the handle 42 is placed over the shroud 40 and for spacing a radio-frequency identification (RFID) element from the tank 12 to prevent or reduce interference caused by the tank 12. As shown, the shroud 40 includes a pair of projections 56 extending from respective ones of the upper protrusions 52 to extend into the handle 42. The RFID element is placed on or near the top of one of the projections 56 to be held between the handle 42 and shroud 40 to prevent removal of the RFID element when the handle 42 is attached to the tank 12.

To prevent rotation of the shroud 40 relative to the mounting collar 20, the shroud 40 includes at least one anti-rotate element that interacts with the mounting collar 20. As illustrated, the shroud 40 includes a pair of protrusions 58 that engage a corresponding one of the notches 30 to prevent rotation, and end portions 60 and 62 at the first and second ends 46 and 48 respectively to prevent rotation. The protrusions 58 project radially inward from the body 44 and are positioned in the space between the upper and lower protrusions 52 and 54 to engage the notches 30. As shown, the protrusions 58 are above respective ones of the lower protrusion 54. The end portions 60 and 62 extend radially inward from the body 44 at the first and second ends 46 and 48 at angles that correspond to the angled portions 32 to abut the angled portions 32 at the first and second ends 24 and 26 of the mounting collar 20 to prevent rotation as shown in FIG. 8. It will be appreciated that the end portions 60 and 62 and protrusions 58 can be used in combination with one another or separately from one another.

Figure 2:
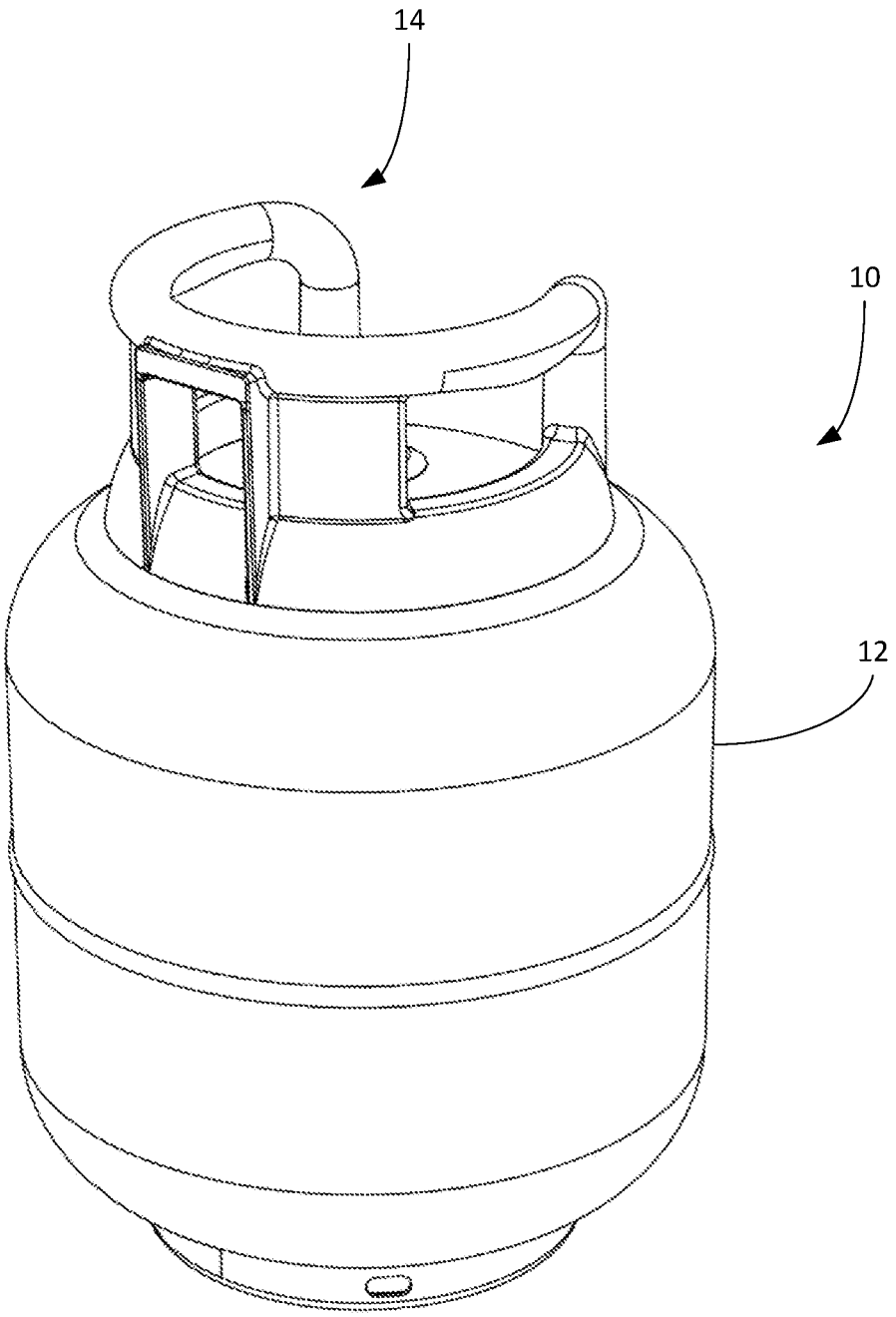
FIG. 2 is a rear perspective view of the gas cylinder.
Figure 3:
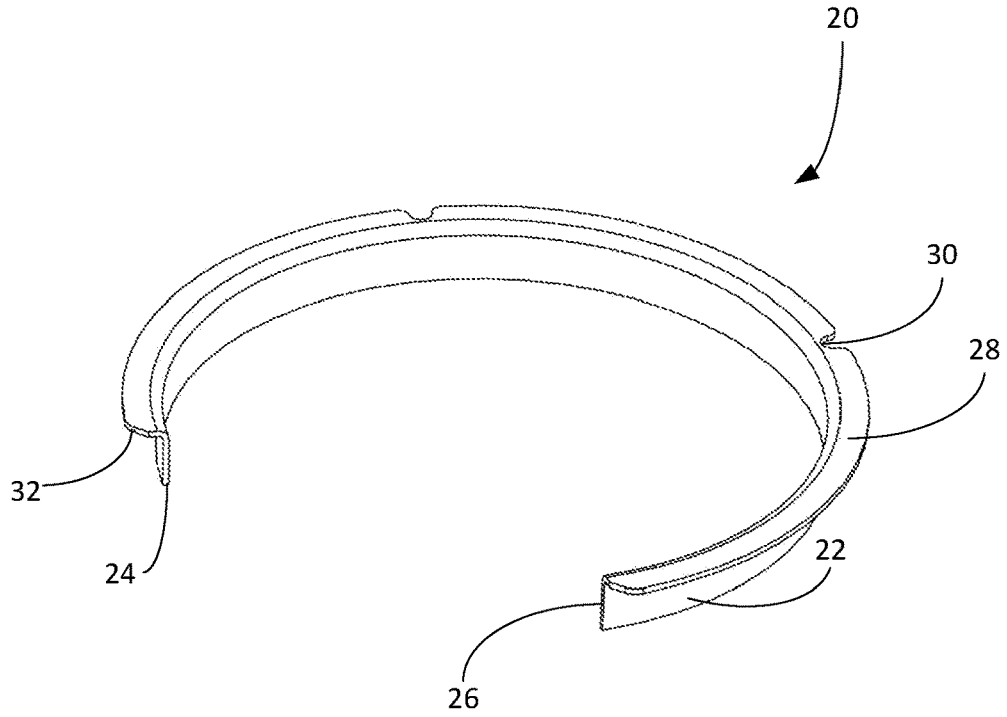
FIG. 3 is a front perspective view of a mounting collar of the gas cylinder.
Figure 4:
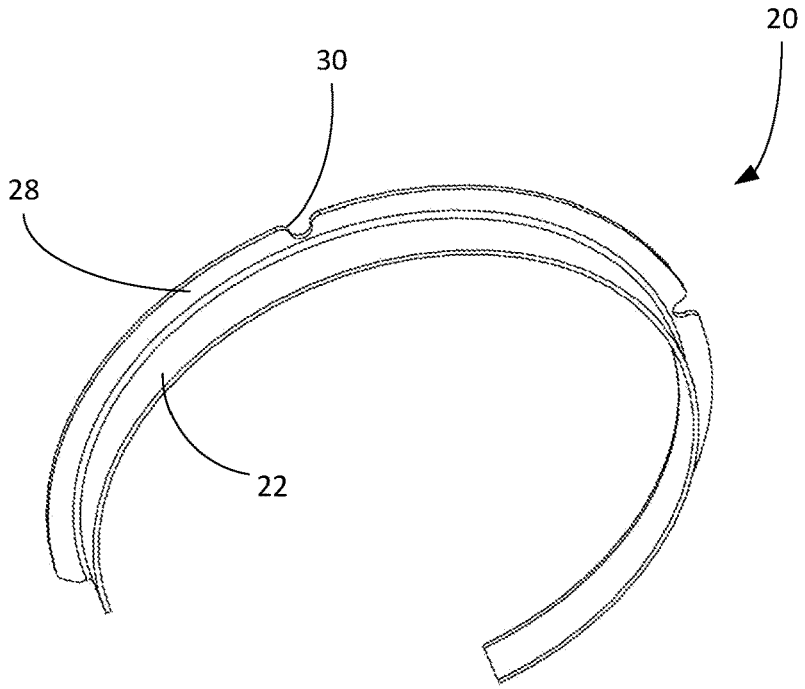
FIG. 4 is a bottom perspective view of the mounting collar.
Figure 9:
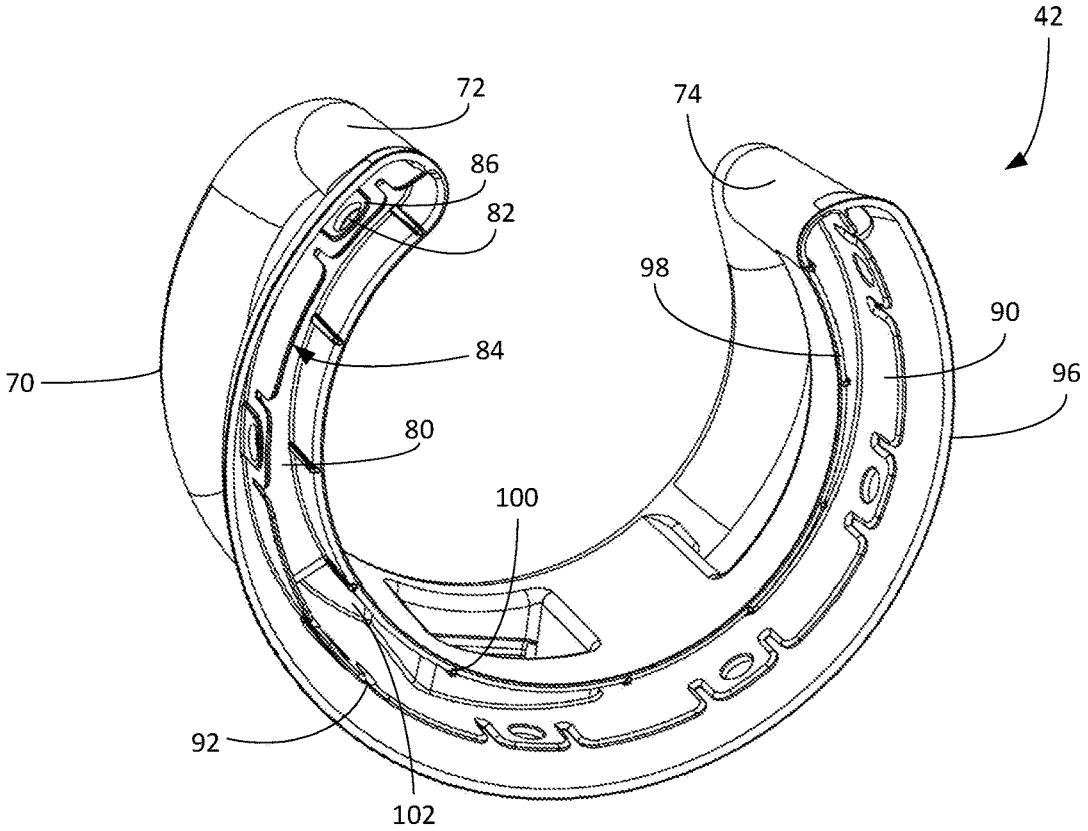
FIG. 9 is a bottom perspective view of a handle of the gas cylinder.
Figure 10:
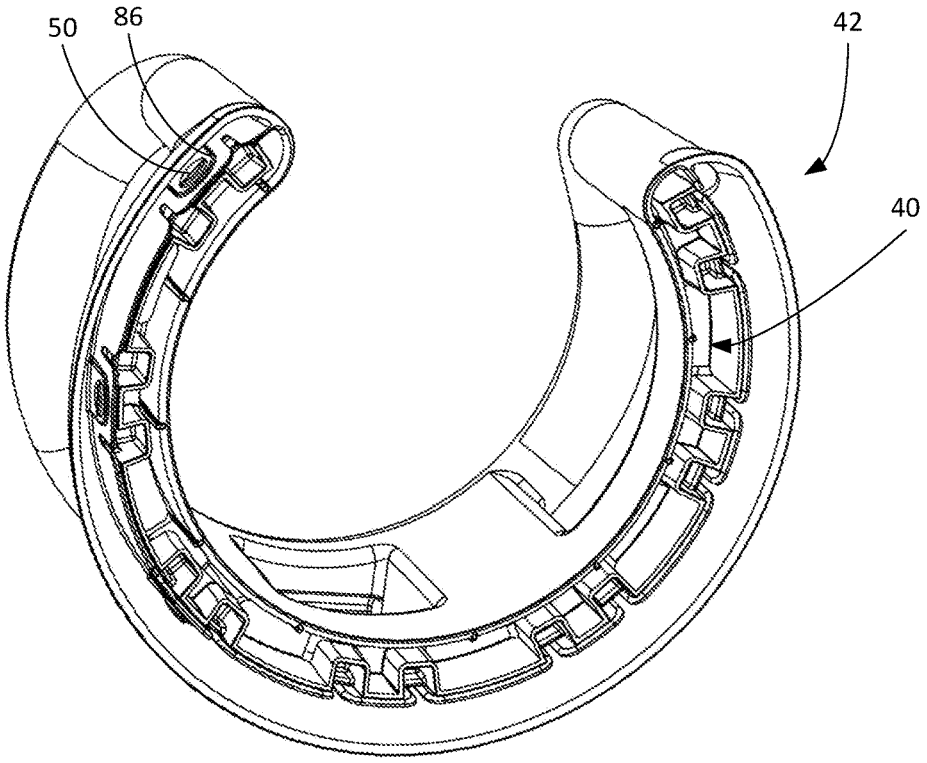
FIG. 10 is a bottom perspective view of the shroud positioned relative to the handle.
Figure 11:
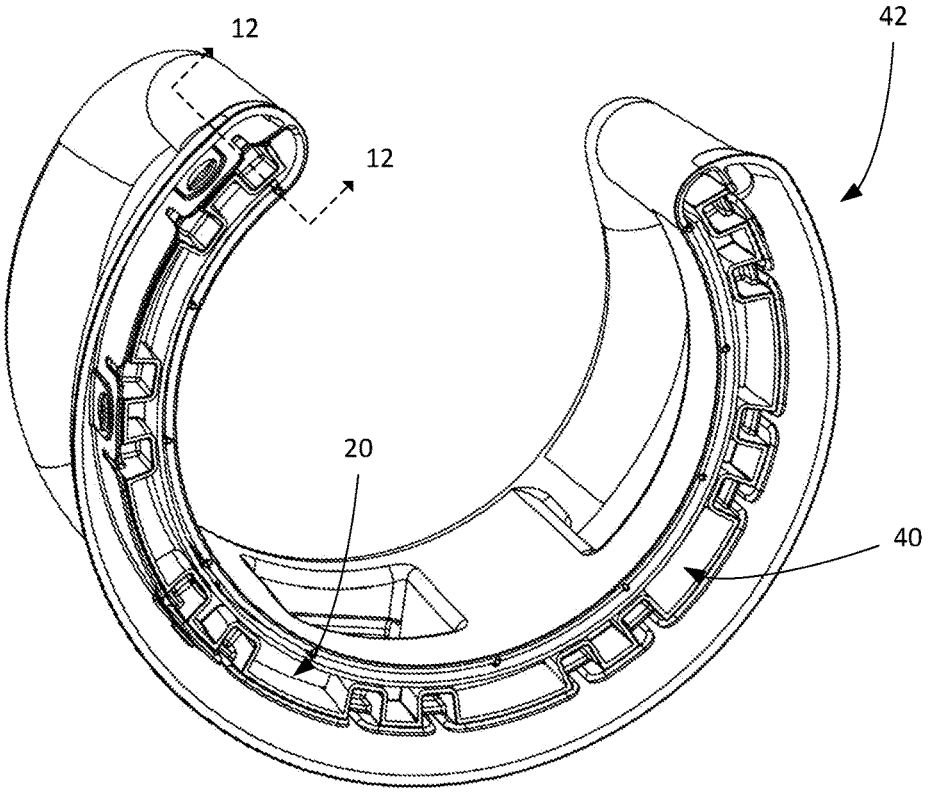
FIG. 11 is a bottom perspective view of the shroud and collar positioned relative to the handle.
Figure 12:
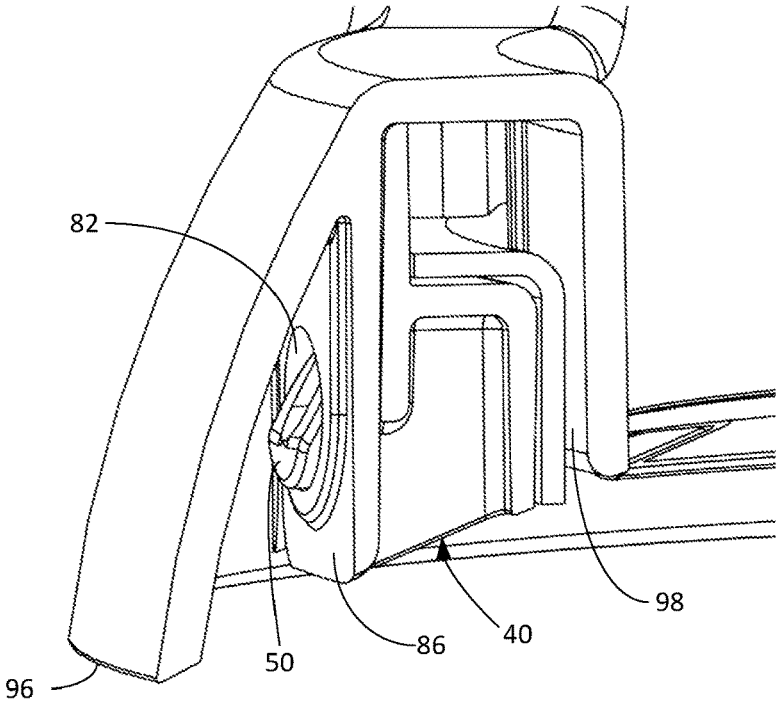
FIG. 12 is a cross-sectional view taken about line 12-12 in FIG. 11.
Figure 13:
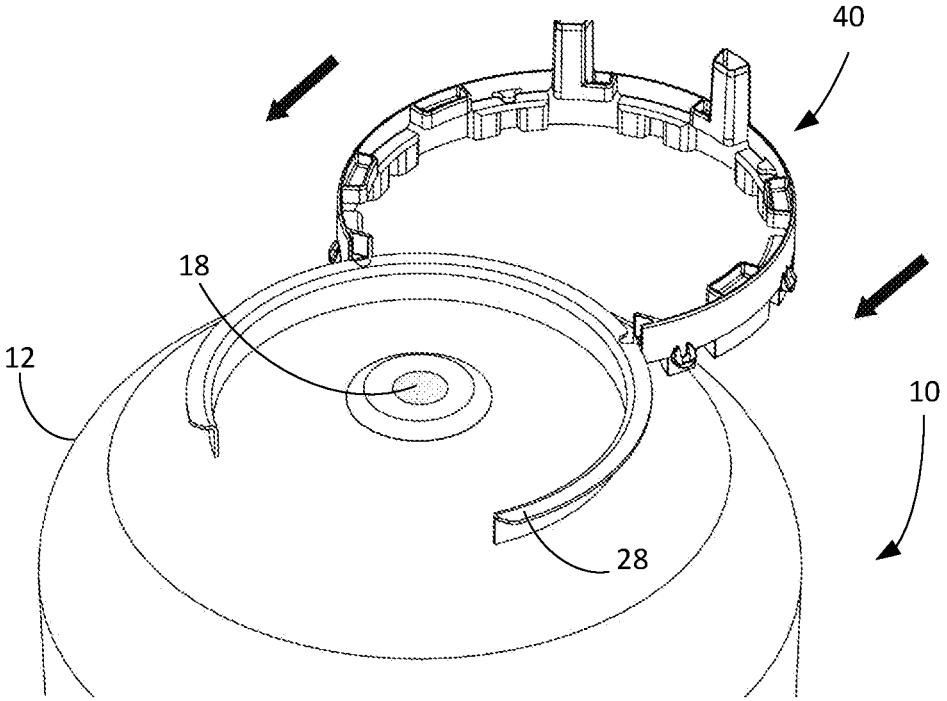
FIG. 13 is a perspective view of the shroud being attached to the mounting collar.
Figure 14:
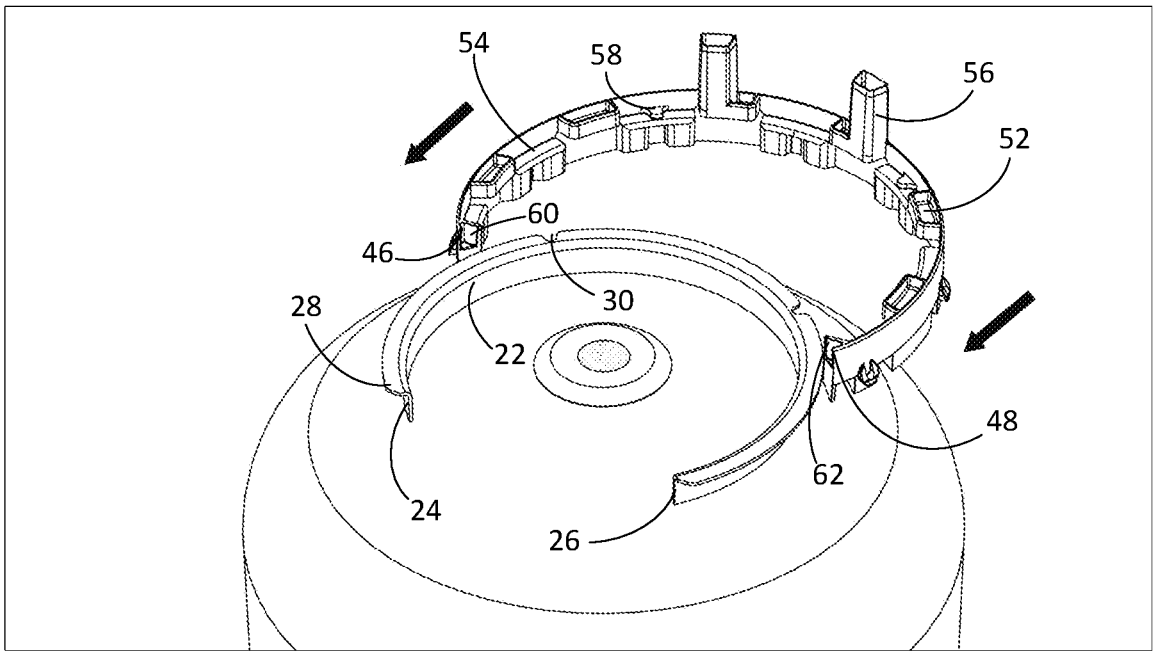
FIG. 14 is another perspective view of the shroud being attached to the mounting collar.
Figure 15:
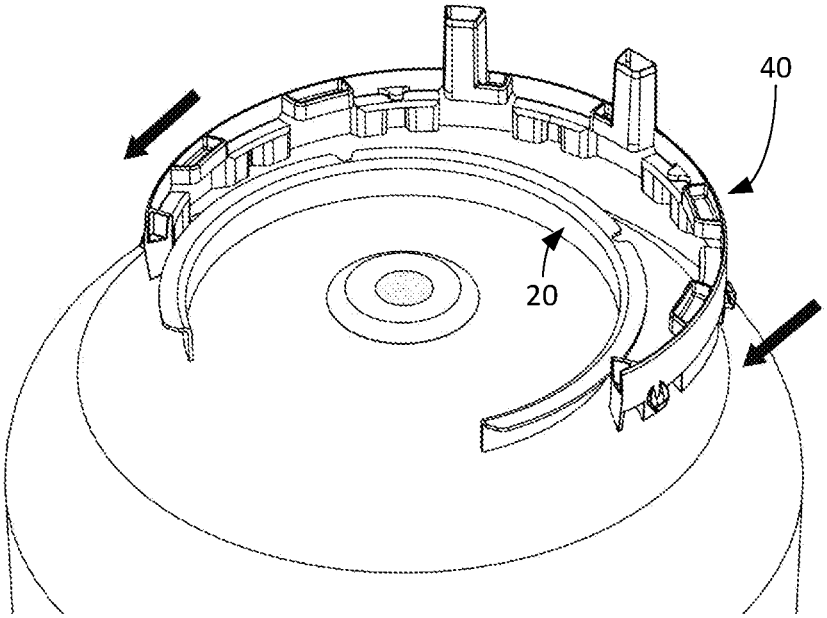
FIG. 15 is still another perspective view of the shroud being attached to the mounting collar.

Referring now to the handle 42 in detail and as shown in FIGS. 1, 2, and 9, the handle 42 has a curved body 70 with first and second ends 72 and 74 circumferentially spaced from one another to define a gap through which the valve extends and is shaped similarly to the mounting collar 20 and shroud 40, such as substantially C-shaped. The body 70 includes a plurality of openings 76 extending therethrough to reduce weight of the handle 42, and as shown three openings spaced around the body, although it will be appreciated that any suitable number of openings may be provided. The body 70 and openings 76 define grip areas 78 at a top of the handle 42 for a user to grasp the handle 42 to transport the cylinder 10.

The body 70 defines a channel 80 at its bottom for receiving the shroud 40 and mounting collar 20. The channel 80 includes a plurality of openings 82 in a wall 84 thereof through which the locking protrusions 50 extend to secure the handle 42 to the shroud 40. As shown the wall 84 of the channel 80 includes a plurality of deflectable tabs 86 each having at least one of the openings 82. The deflectable tabs 86 are configured to be deflected outward by a respective one of the locking protrusions 50 during attachment of the handle 42 to the shroud 40 until the locking protrusions 50 extend through the openings 82, at which point the deflectable tabs 86 return to their original position. The deflectable tabs 86 are spaced from adjacent portions 90 of the wall 84 by slots 92 that extend a portion of the height of the channel 80, and an inner surface of each deflectable tab 86 and adjacent portion 90 is configured to abut an outer surface of the shroud 40 when attached.

The body 70 also includes an outer wall 96 outwardly spaced from the wall 84 and an inner wall 98 inwardly spaced from the wall 84 that forms with the wall 84 the channel 80. The walls 96 and 98 abut the upper portion 16 when the handle 42 is attached to the gas tank 12 to close off the channel 80. The inner wall 98 includes a plurality of spaced ribs 100 on an inner surface thereof in the channel 80 that abut the body 22 of the collar 20 when attached. The body 70 also includes receiving areas 102 defined within the body for receiving the projections 56.

Turning now to FIGS. 13-26, the attachment of the handle assembly 14 to the gas tank 12 will be described. Referring initially to FIGS. 13-16, to attach the shroud 40 to the collar 20, the shroud 40 is deflected from a first position shown in FIG. 13 to an intermediate position shown in FIG. 14 where the first and second ends 46 and 48 are deflected away from one another and then to a second position shown in FIG. 15. For example, a user can grasp the first and second ends 46 and 48 and deflect the ends outward. The shroud 40 is then positioned around the collar 20 with the first and second ends 46 and 48 deflected away from one another and generally aligned with the first and second ends 24 and 26 of the collar 20, and the shroud 40 is lowered onto the collar 20 until at least some of the upper protrusions 52 abut the flange 28 of the mounting collar 20.

Figure 16:
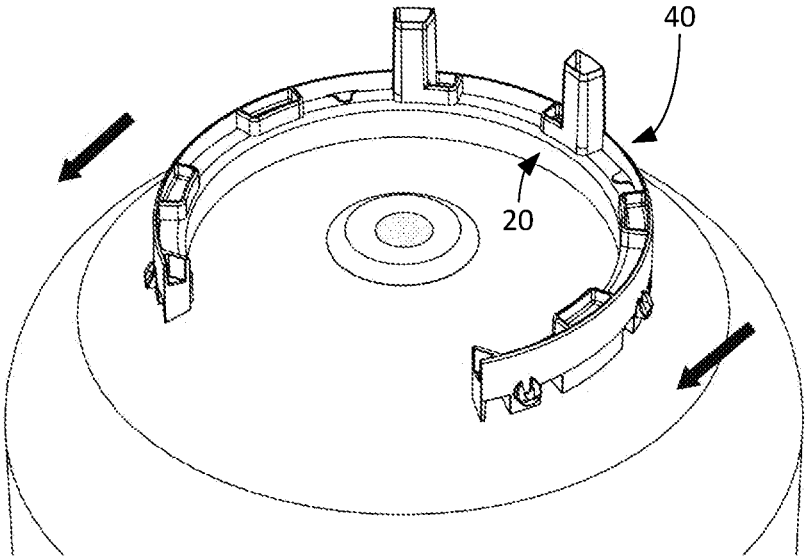
FIG. 16 is a perspective view of the shroud attached to the mounting collar.
Figure 17:
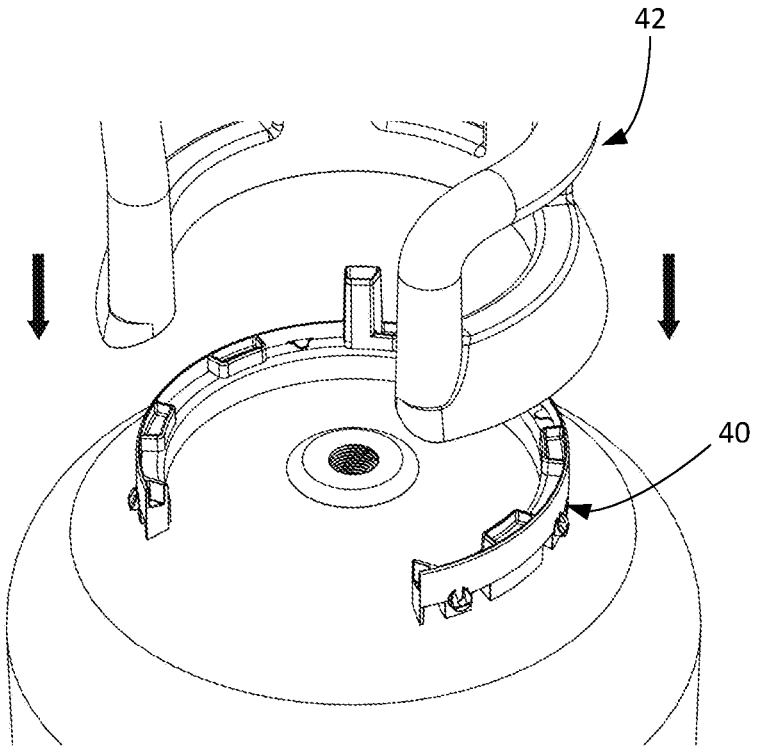
FIG. 17 is a perspective view of the handle being attached to the shroud.
Figure 18:
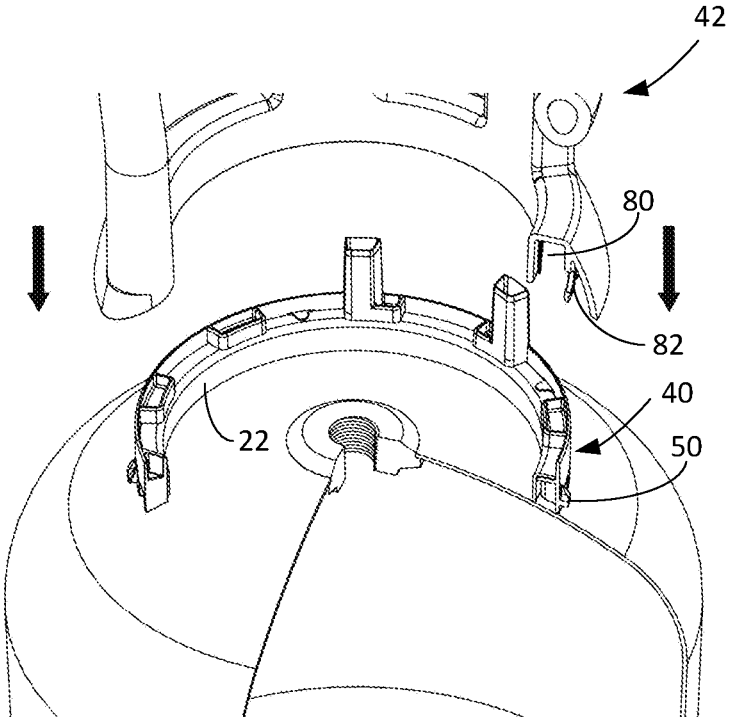
FIG. 18 is another perspective view of the handle being attached to the shroud.
Figure 19:
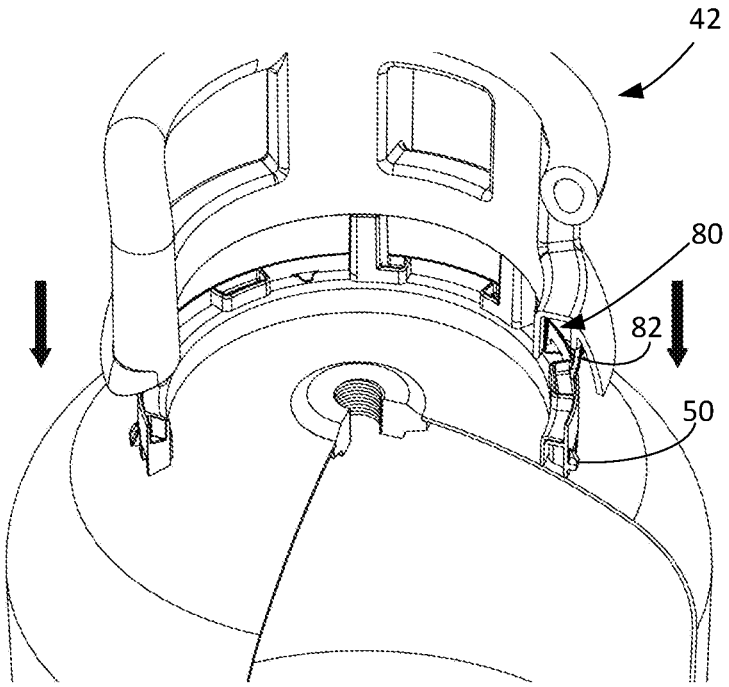
FIG. 19 is still another perspective view of the handle being attached to the shroud.

The first and second ends 46 and 48 are then moved toward one another to the first position as shown in FIG. 16 until the first and second ends 46 and 48 of the shroud 40 are proximate the first and second ends 24 and 26 of the collar 20 and the first and second end portions 60 and 62 of the shroud 40 abut the angled portions 32 at the first and second ends 24 and 26 of the mounting collar as shown in FIG. 8 to prevent rotation. Additionally, when in the position shown in FIG. 16, the protrusions 58 are received in the notches 30 to prevent rotation of the shroud 40 relative to the mounting collar 20, a bottom surface of each upper protrusion 52 abuts a top surface of the flange 28 to prevent downward movement of the shroud 40 relative to the collar 20, and an upper surface of each lower protrusion 54 abuts a bottom surface of the flange 28 to prevent upward movement of the shroud 40 relative to the collar 20.

Figure 20:
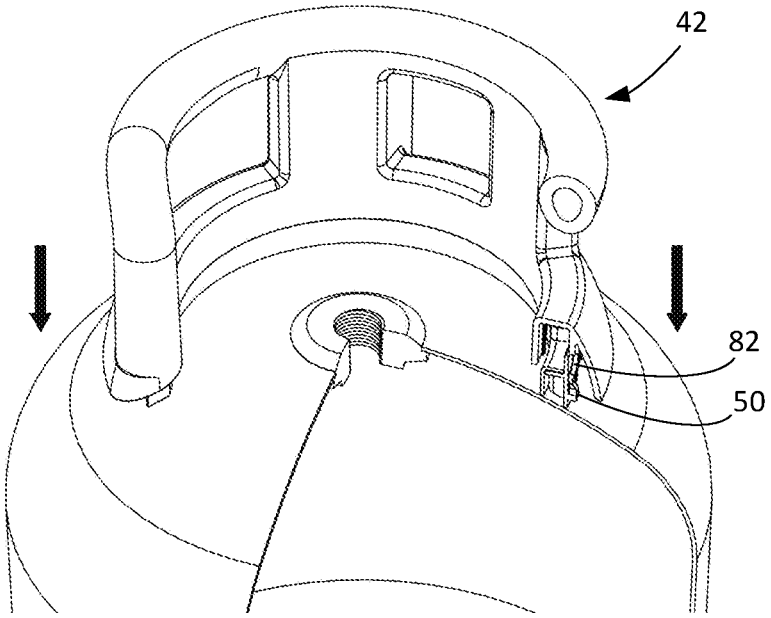
FIG. 20 is yet another perspective view of the handle being attached to the shroud.
Figure 21:
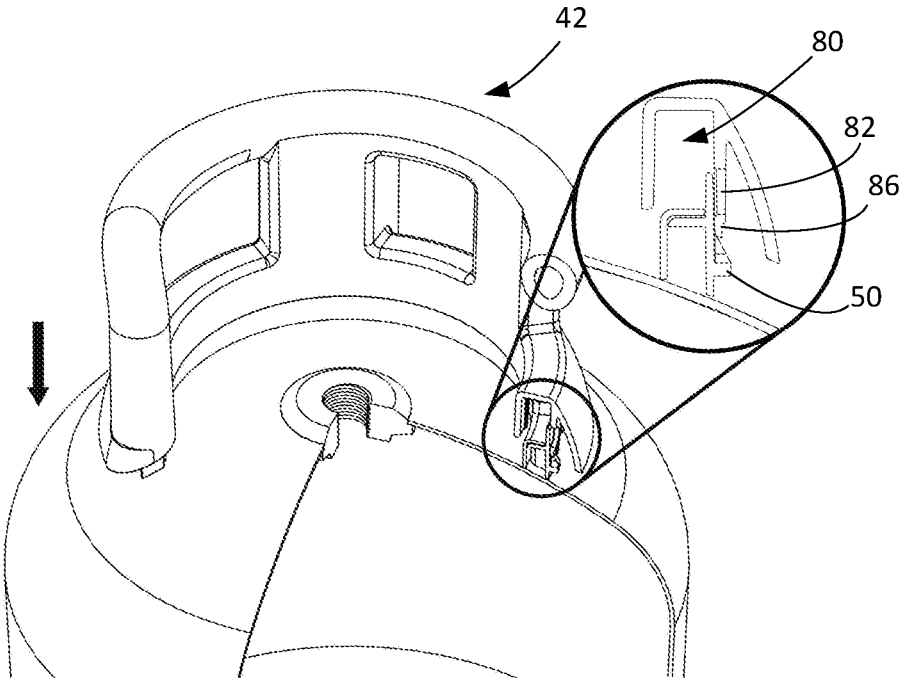
FIG. 21 is another perspective view of the handle being attached to the shroud.
Figure 22:
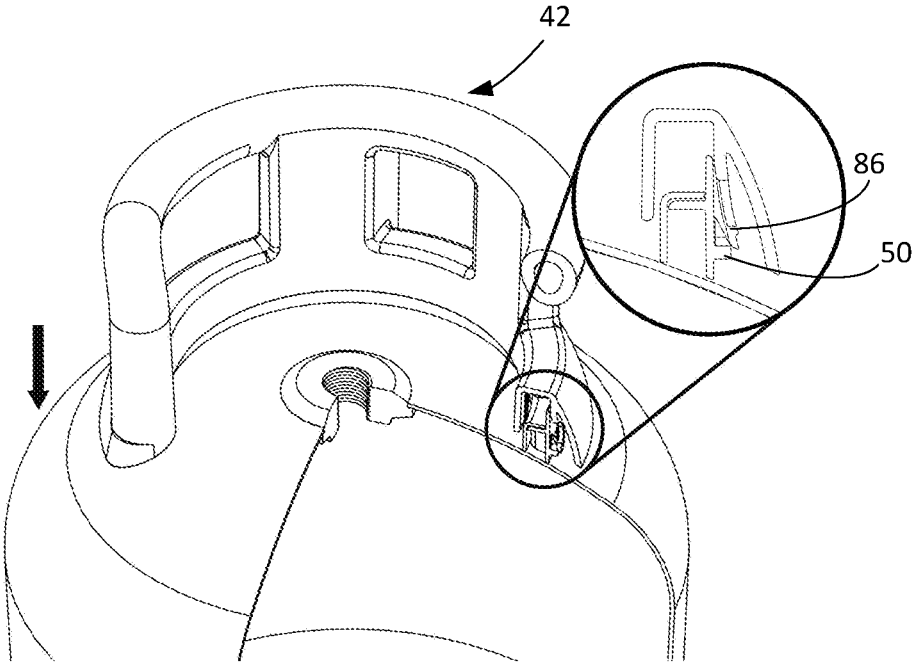
FIG. 22 is still another perspective view of the handle being attached to the shroud.
Figure 23:
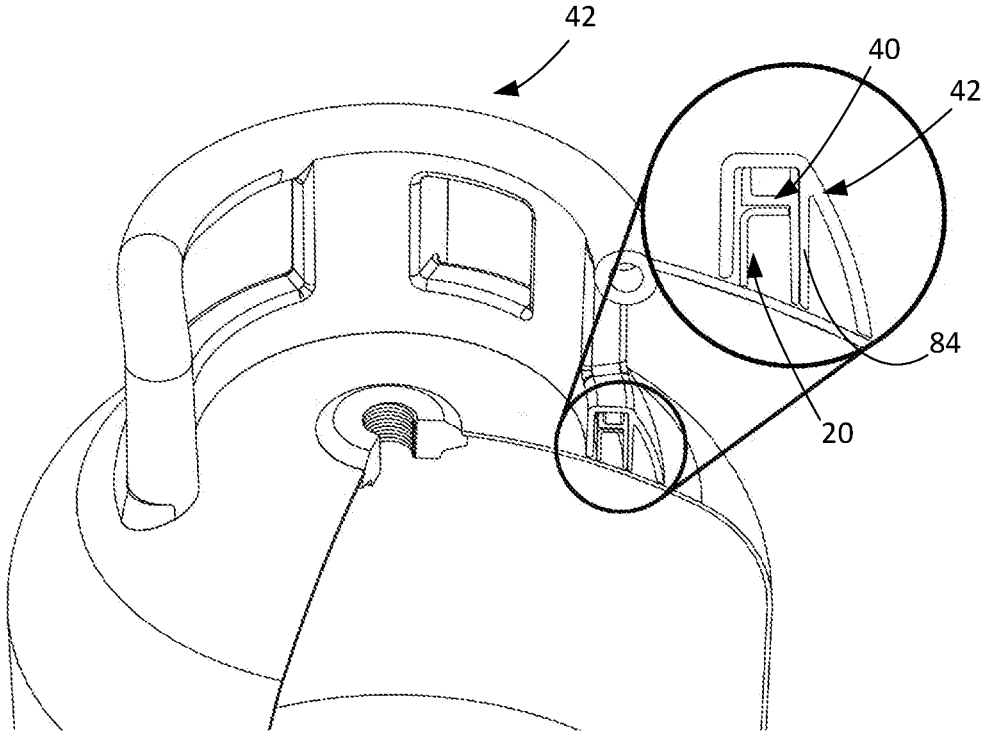
FIG. 23 is a perspective view of the handle attached to the shroud.
Figure 24:
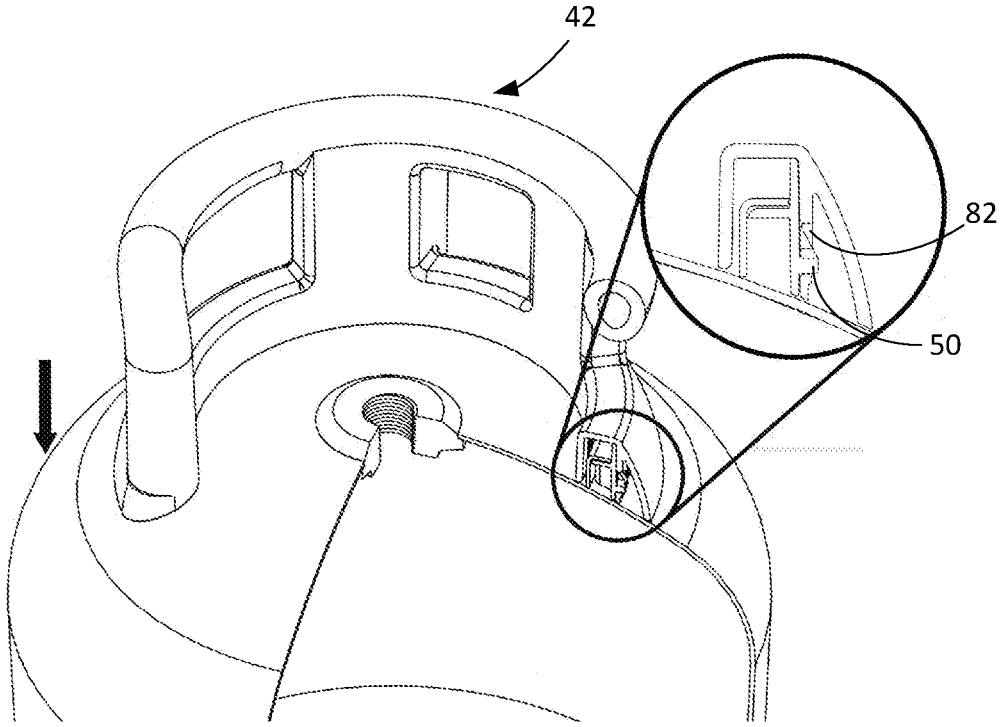
FIG. 24 is another perspective view of the handle attached to the shroud.
Figure 25:
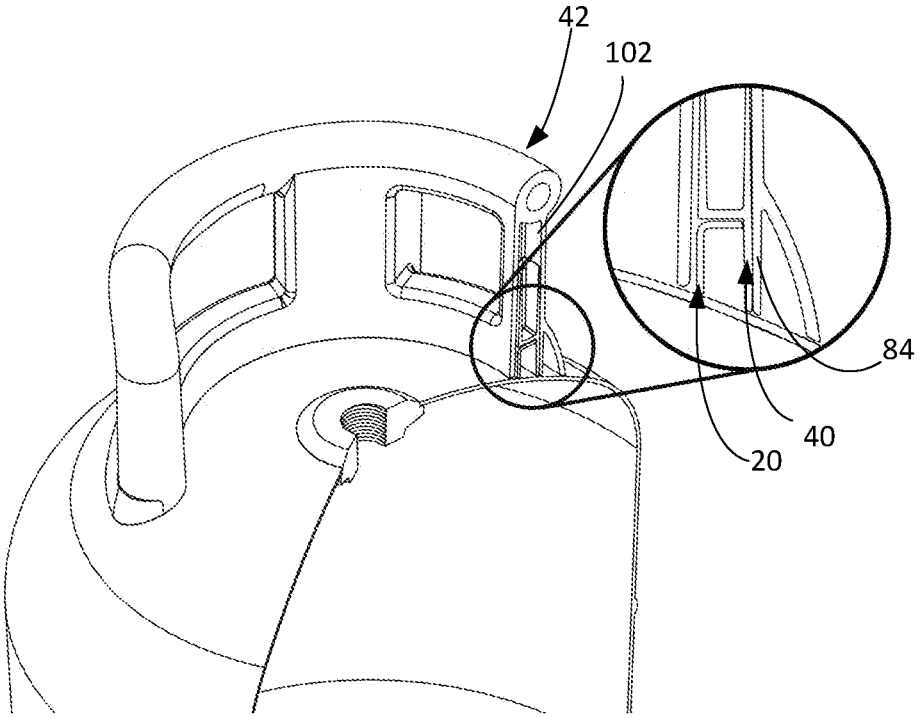
FIG. 25 is yet another perspective view of the handle attached to the shroud.
Figure 26:
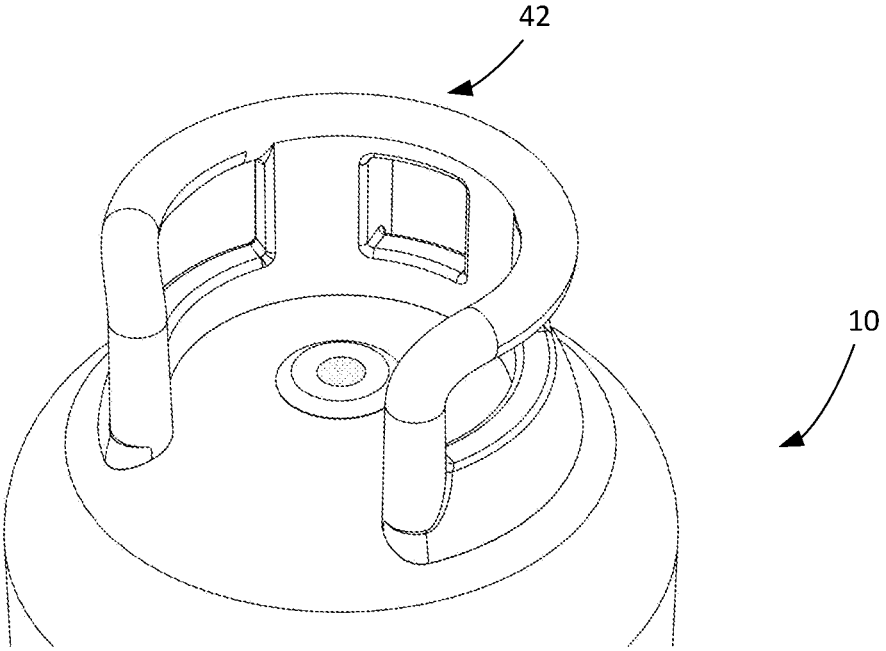
FIG. 26 is a further perspective view of the handle attached to the shroud.

Referring now to FIGS. 17-26, the attachment of the handle 42 to the shroud will be described in detail. FIGS. 18-25 show the cylinder 10 with portions cutaway to illustrate the attachment of the handle 42. To attach the handle 42 to the shroud 40, the first and second ends 72 and 74 of the handle 42 are aligned with the first and second ends 46 and 48 of the shroud 40 and the projections 56 of the shroud 40 are aligned with the corresponding receiving areas 102 in the handle 42. The handle 42 is then lowered onto the shroud 40. As the handle 42 is lowered, the shroud 42 and mounting collar 20 are received in the channel 80 as shown in FIG. 20. As the handle 42 is continually lowered, the deflectable tabs 86 are engaged by and deflected outward by the corresponding locking protrusions 50 as shown in FIG. 22. The handle 42 is then lowered further until the locking protrusions 50 enter the openings 82 in the respective deflectable tabs 86 and extend out of the openings 82 to secure the handle 42 to the shroud 40 as shown in FIG. 24 and the deflectable tabs 86 return to their original position. In an embodiment, the deflectable tabs 86 may make an audible sound as they snap back into their original position to indicate to the user that the connection is complete. When the locking protrusions 50 are disposed in the openings 80, the bottom of the handle 42 will be in contact with the upper portion 16 of the tank 12, and will be prevented from rotating by the anti-rotate elements on the shroud 40, such as the protrusions 58 and the end portions 60 and 62. As shown, the walls 96 and 98 will be abutting the upper portion 16 to conceal the shroud 40 and the mounting collar 20. As shown in FIG. 25, the projections 56 of the shroud 40 are disposed in the corresponding receiving areas 102 in the handle 42.

The aforementioned systems, components, (e.g., handles, cylinders, among others), and the like have been described with respect to interaction between several components and/or elements. It should be appreciated that such devices and elements can include those elements or sub-elements specified therein, some of the specified elements or sub-elements, and/or additional elements. Further yet, one or more elements and/or sub-elements may be combined into a single component to provide aggregate functionality. The elements may also interact with one or more other elements not specifically described herein.

While the embodiments discussed herein have been related to the systems and methods discussed above, these embodiments are intended to be exemplary and are not intended to limit the applicability of these embodiments to only those discussions set forth herein.

The above examples are merely illustrative of several possible embodiments of various aspects of the present invention, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (e.g., that is functionally equivalent), even though not structurally equivalent to the disclosed structure which performs the function in the illustrated implementations of the invention. In addition although a particular feature of the invention may have been disclosed with respect to only one of several implementations, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising."

This written description uses examples to disclose the invention, including the best mode, and also to enable one of ordinary skill in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that are not different from the literal language of the claims, or if they include equivalent structural elements with insubstantial differences from the literal language of the claims.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify a quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Moreover, unless specifically stated otherwise, a use of the terms "first," "second," etc., do not denote an order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

The best mode for carrying out the invention has been described for purposes of illustrating the best mode known to the applicant at the time and enable one of ordinary skill in the art to practice the invention, including making and using devices or systems and performing incorporated methods. The examples are illustrative only and not meant to limit the invention, as measured by the scope and merit of the claims. The invention has been described with reference to preferred and alternate embodiments. Obviously, modifications and alterations will occur to others upon the reading and understanding of the specification. It is intended to include all such modifications and alterations insofar as they come within the scope of the appended claims or the equivalents thereof. The patentable scope of the invention is defined by the claims, and may include other examples that occur to one of ordinary skill in the art. Such other examples are intended to be within the scope of the claims if they have structural elements that do not differentiate from the literal language of the claims, or if they include equivalent structural elements with insubstantial differences from the literal language of the claims.

What is claimed is:

1. A handle assembly for a cylinder comprising:

a shroud configured to attach to a collar of the cylinder to partially surround a valve port of the cylinder, the shroud having a body with first and second ends circumferentially spaced from one another to define a gap through which a valve is configured to extend, and a plurality of circumferentially spaced locking protrusions projecting from the body; and a handle configured to attach to the shroud, the handle having a body defining a channel for receiving the shroud, and first and second ends circumferentially spaced from one another to define a gap through which the valve is configured to extend, wherein the channel includes a plurality of openings in a wall thereof through which the locking protrusions extend when the handle is attached to the shroud to secure the handle to the shroud.

2. The handle assembly according to claim 1, wherein the wall of the channel includes a plurality of deflectable tabs each having at least one of the openings, and wherein the deflectable tabs are configured to be deflected by the locking protrusions during attachment of the handle to the shroud until the locking protrusions extend through the openings.

3. The handle assembly according to claim 2, wherein the locking protrusions are angled such that a lower portion of each protrusion projects radially outward from an outer surface of the shroud farther than an upper portion of the respective protrusion.

4. The handle assembly according to claim 1, wherein the shroud has a first orientation, wherein the shroud is deflectable to a second orientation for attachment to the collar, and wherein when attached to the collar the shroud returns to the first orientation.

5. The handle assembly according to claim 1, wherein the shroud additionally includes at least one upper protrusion projecting from the body to prevent downward movement of the shroud in a first direction relative to the collar and at least one lower protrusion projecting from the body to prevent upward movement of the shroud relative to the collar in a second direction opposite the first direction.

6. The handle assembly according to claim 5, wherein the upper and lower protrusions alternate around the shroud.

7. The handle assembly according to claim 1, wherein the shroud additionally includes at least one anti-rotate element configured to interact with the collar to prevent rotation of the shroud relative to the collar.

8. The handle assembly according to claim 7, wherein the at least one anti-rotate element includes at least one protrusion configured to engage a corresponding recess in the collar to prevent rotation.

9. The handle assembly according to claim 7, wherein the at least one anti-rotate element includes end portions at the first and second ends of the shroud that are configured to abut end portions of the collar to prevent rotation.

10. The handle assembly according to claim 9, wherein the end portions extend radially inward from the body at the first and second ends at angles to abut the end portions of the collar.

11. The handle assembly according to claim 1, wherein the shroud additionally includes at least one projection extending upward in a first direction serving as a guide for the handle and for spacing a radio-frequency identification element from the cylinder to reduce interference caused by the cylinder.

12. The handle assembly according to claim 1, wherein the shroud and handle are plastic.

13. A portable gas cylinder comprising:

a gas tank having an upper portion having a valve port and a collar partially surrounding the valve port, the collar having first and second ends circumferentially spaced from one another to define a gap through which a valve is configured to extend, a base, and a flange extending radially outwardly from the base; and a handle assembly attached to the gas tank, the handle assembly including:

a shroud having a body attached to the collar with first and second ends circumferentially spaced from one another to define a gap through which the valve is configured to extend, and a plurality of circumferentially spaced locking protrusions projecting from the body; and a handle attached to the shroud, the handle having a body defining a channel in which the shroud is disposed and first and second ends circumferentially spaced from one another to define a gap through which the valve is configured to extend, wherein the channel includes a plurality of openings in a wall thereof through which the locking protrusions extend to secure the handle to the shroud.

14. The portable gas cylinder according to claim 13, wherein the shroud additionally includes at least one upper protrusion projecting from the body above the flange of the collar to prevent downward movement of the shroud in a first direction relative to the collar, and at least one lower protrusion projecting from the body below the flange of the collar to prevent upward movement of the shroud relative to the collar in a second direction opposite the first direction.

15. The portable gas cylinder according to claim 13, wherein the flange of the collar includes at least one notch and the shroud additionally includes at least one protrusion that engages the notch in the collar to prevent rotation of the shroud relative to the collar.

16. The portable gas cylinder according to claim 13, wherein the locking protrusions are angled such that a lower portion of each protrusion projects radially outward from an outer surface of the shroud farther than an upper portion of the respective protrusion.

17. The portable gas cylinder according to claim 13, wherein the flange includes angled portions at ends thereof and the shroud includes end portions extending radially inward from the body at the first and second ends at angles that correspond to the angled portions to abut the angled portions at the first and second ends of the mounting collar to prevent rotation of the shroud relative to the collar.

18. The portable gas cylinder according to claim 13, wherein the shroud additionally includes at least one projection extending upward in a first direction serving as a guide for the handle and for spacing a radio-frequency identification element from the gas tank to reduce interference caused by the gas tank.

19. A method of assembling a portable gas cylinder, the gas cylinder including a handle assembly and a gas tank having an upper portion having a valve port and a collar partially surrounding the valve port, the method comprising:

deflecting a shroud of the handle assembly from a first position to a second position where ends of the shroud are moved away from one another;

positioning the shroud around the collar until the shroud surrounds the collar and is returned to the first position;

lowering a handle of the handle assembly toward the shroud until that the shroud and collar are received in a channel of the handle and locking protrusions of the shroud are received in openings in a wall of the channel.

20. The method according to claim 19, wherein when the handle is lowered, deflectable tabs of the handle that each include one of the openings are engaged by and deflected outward by a corresponding one of the locking protrusions until the locking protrusions enter the openings in the respective deflectable tabs and extend out of the openings to secure the handle to the shroud.

* * * * *